United States Patent [19]

De Woskin

[11] Patent Number: 4,616,436

[45] Date of Patent: Oct. 14, 1986

[54] IDENTIFICATION BAND

[76] Inventor: Irvin S. De Woskin, Highway "M"-P.O. Box 278, Barnhart, Mo. 63012-0278

[21] Appl. No.: 692,161

[22] Filed: Jan. 17, 1985

[51] Int. Cl.[4] ..... G09F 3/14

[52] U.S. Cl. ..... 40/21 C; 24/16 PB

[58] Field of Search ..... 24/16 PB, 17; 40/21 C, 40/21 R, 10 R; 128/DIG. 15; 119/106

[56] References Cited

U.S. PATENT DOCUMENTS

| | | | |
|---|---|---|---|
| 2,641,074 | 6/1953 | Richmond | 40/21 C |
| 4,078,324 | 3/1978 | Wiebe | 40/21 C |
| 4,091,766 | 5/1978 | Colliard | 40/21 C |
| 4,314,414 | 2/1982 | De Woskin | 40/21 C |
| 4,352,253 | 10/1982 | Oswalt | 40/21 C |

*Primary Examiner*—Gene Mancene
*Assistant Examiner*—Wenceslao J. Contreras
*Attorney, Agent, or Firm*—Senniger, Powers, Leavitt and Roedel

[57] ABSTRACT

An identification band having means to carry identification data and a system of hook and plush elements to secure it about a persons limb.

10 Claims, 9 Drawing Figures

IDENTIFICATION BAND

BACKGROUND OF THE INVENTION

This invention relates to identification bands, and more particularly to bands which may be formed into identification bracelets for patients in hospitals or similar institutions.

The invention is in the same general field as that of the bands disclosed in U.S. Pat. Nos. 2,561,894, 2,954,620, 3,027,665, 3,153,869, 3,197,899, 3,279,107, 4,078,324 and 4,314,415.

SUMMARY OF THE INVENTION

Among the several objects of the invention may be noted the provision of an improved identification band adapted to be formed into a bracelet and applied to a person's wrist or ankle and effectively secured in place on the wrist or ankle in simple manner without the use of tools, and without having any metal fasteners or other metal components; the provision of such a band enabling ready waterproof association therewith of an insert bearing identification indicia, with the indicia readable visually or by automated reading equipment; and the provision of such a band which is of relatively simple and economical construction.

In general, an identification band of this invention comprises a strip adapted to extend around a person's wrist or ankle and to carry identification data, and hook and plush fastening elements for fastening the strip around the wrist or ankle. One of said elements forms one side of a loop means at one of said strip. The other element is a relatively long and narrow element at the other end of the strip. A protective strip is provided on said other element extending lengthwise thereof secured to said other element adjacent the free end thereof. Said other element and the protective strip are adapted to be passed through the loop means to the point where the band encircles the wrist or ankle to the desired extent, whereupon the portion of said other element and the protective strip extending out of the loop may be cut off, the protective strip pulled out, and the elements pressed together to secure the band around the wrist or ankle, the loop means preventing separation of the elements.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figures 1, 2, 3, 4, 5:
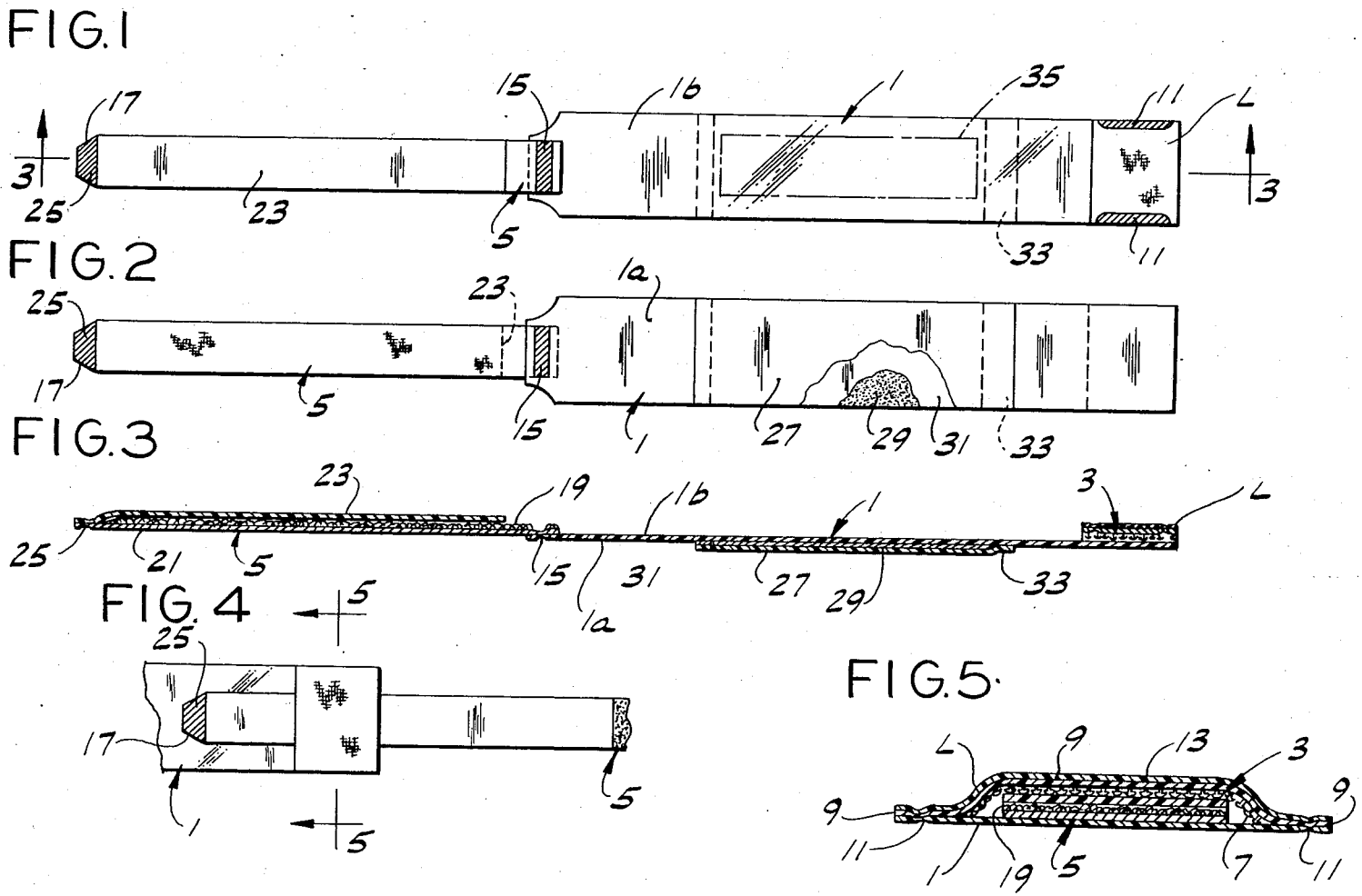
FIG. 1 is plan of an identification band of this invention as viewed from the side thereof which is on the outside as the band is applied to the wrist or ankle.
FIG. 2 is a plan of the band from the other side (the inside)
FIG. 3 is a longitudinal section of the band on line 3—3 of FIG. 1.
FIG. 4 is a fragmentary plan showing the left end of the band as viewed in FIG. 1 inserted in the right end.
FIG. 5 is an enlarged transverse section on line 5—5 of FIG. 4.

Referring to the drawings, an identification band of this invention is shown to comprise a strip 1 adapted to extend around a person's wrist or ankle and adapted to carry identification data, as will appear. This strip is preferably a strip of transparent flexible thermoplastic material, preferably an ultrasonically sealable material such as a strip of 15–20 mil transparent polyurethane ester film about six inches long and one inch wide. The band further comprises first and second fastening elements indicated at 3 and 5 for fastening the strip 1 around the ankle or wrist. As herein illustrated, the first fastening element 3 is a hook element and the second fastening element 5 is a plush element of the type adapted for securement by pressing the hooks of the hook element into the plush of the plush element, i.e., VELCRO or VELCRO-type fastening elements.

The first or hook element 3 is secured to the strip 1 at one end thereof in such manner as to form one side of a loop means L at that end of the strip in conjunction with the strip. This element 3 is constituted by a rectangular piece of thermoplastic hook material, preferably an ultrasonically sealable material such as nylon, and also preferably such material in which the hooks 7 are generally of mushroom shape extending from one face of a substrate 9 (see FIG. 5). It extends transversely across the strip 1 adjacent the stated one end of the strip from adjacent one end of the strip to adjacent the other with substrate 9 on the outside relative to the strip 1 and hooks 7 extending toward the strip 1, and is secured at its side edges to the strip by heat seals as indicated at 11, preferably ultrasonic seals, thus forming a loop like a belt loop at said end of the strip. Preferably, the element 3 has a backing 13 of a suitable ultrasonically sealable material compatible with element 3.

The second fastening element 5 (the plush element) is a relatively long and narrow element at the other end of the strip 1 from the first fastening element 3. It is constituted by a narrow strip of thermoplastic plush material, preferably an ultrasonically sealable material such as a nylon plush material, which may be about one-half inch wide and about four inches long, for example, ultrasonically heat-sealed at one end as indicated at 15 to the other end of the strip from the loop end. The outer free end of the plush strip 5 may be tapered as indicated at 17 to facilitate passing it (threading it) through the loop at L, i.e., between strip 1 and the hooks 7 of element 3 at the stated one end of the strip 1 in the application of the band to the wrist or ankle, as will appear. The plush strip 5 has plush 19 on one face of a substrate 21, and is secured to the strip 1 with the plush 19 on the same side as the element 3. This side is that which is on the outside as the band is applied to the wrist or ankle. A strip 23 of material such as a thermoplastic plastic film, preferably an ultrasonically sealable film such as polyester film, extends lengthwise of the plush strip 5 over the plush 19 for protecting the plush from engagement with the hooks 7 until ready, as will appear. This protective strip 23 is secured at one end thereof to the free end of the plush strip 5 by an ultrasonic heat seal as indicated at 25.

At 27 as indicated a length of transparent plastic tape, e.g., a polyester tape, having a pressure-sensitive adhesive 29 on one face thereof constituting its inside face, with a release member 31 of paper or the like covering the pressure-sensitive adhesive except for an area 33 of the adhesive at one end of the tape. The tape, which may be of the same width as strip 1, is shorter than the strip 1 and is secured by means of the exposed area 33 of the adhesive to the strip 1 on face 1*a* of the strip (which is its inside face as applied to the wrist or ankle) extending lengthwise on the strip generally centered with respect to the length of the strip. The release member 31 is disposed between the tape and the strip, and prevents the tape from adhering to the strip until ready.

In the use of the identification band, the release member 31 is peeled off the tape 27, and an insert or label such as indicated in phantom at 35 in FIG. 1 having pre-printed identification indicia on one face thereof is sandwiched between the tape and the strip 1 with the printed face of the insert against the strip 1 so that the printing is visible through the strip from the outside face 1*b* of the strip as it is applied to the wrist or ankle. The label or insert is generally a strip of paper shorter and narrower than the tape and is located so that the tape may be adhered by means of the pressure-sensitive adhesive 29 to the strip 1 all around the label or insert to seal the latter between the tape and the strip thereby to prevent it from being exposed to moisture.

Figure 6:
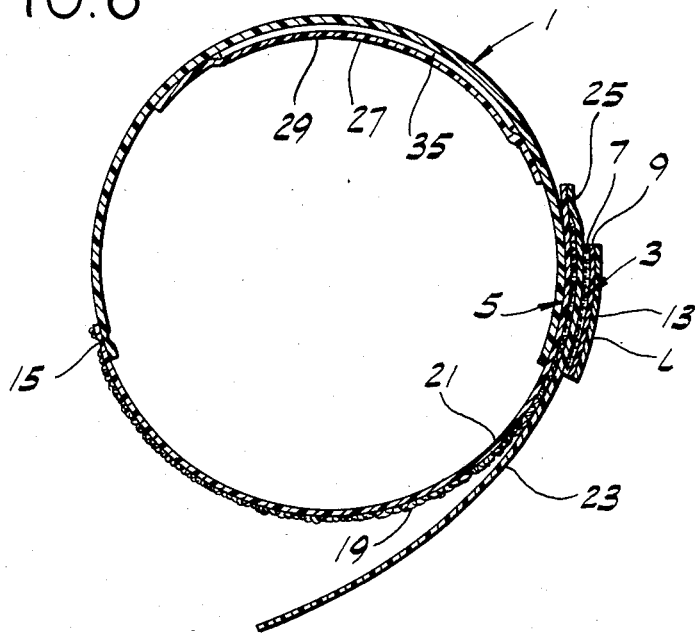
FIG. 6 is a section of the band showing how it is wrapped around the wrist or ankle and one end partially inserted in the other.
Figure 7:
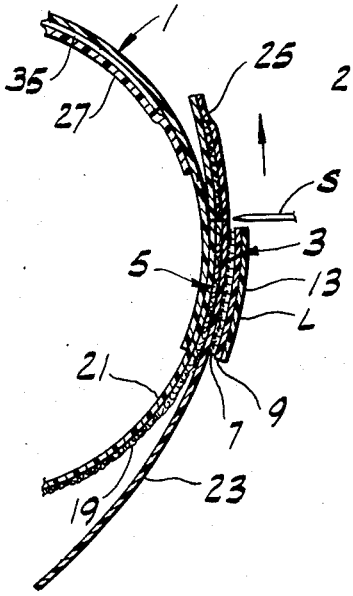
FIG. 7 is a fragment of FIG. 6 showing the one end pulled through and about to be cut.
Figure 8:
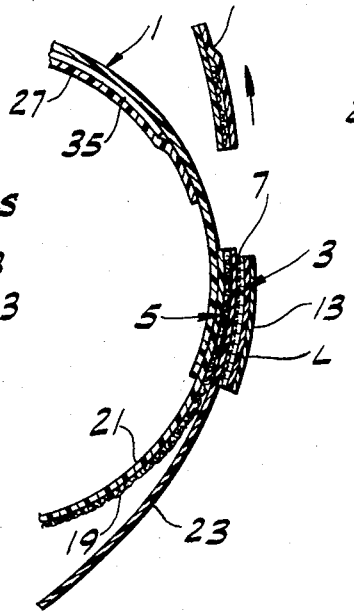
FIG. 8 is a view similar to FIG. 7 showing the one end cut.
Figure 9:
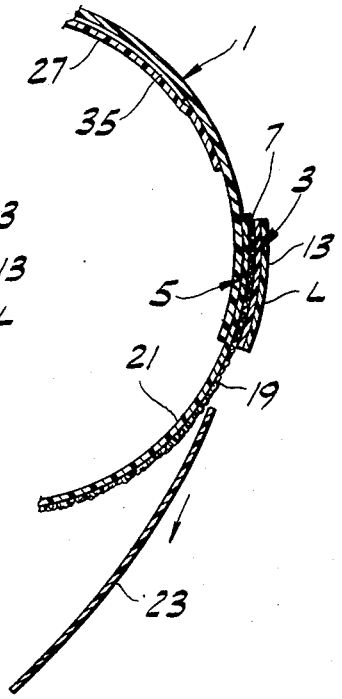
FIG. 9 is a view similar to FIG. 8 showing a protective strip removed and the ends secured.

With the label or insert 35 in place, the band is wrapped around the wrist or ankle of the patient with the loop L on the outside (and with the label or insert 35 facing out) and the plush strip 5 with the protective strip 23 on the plush face 19 thereof is passed through the loop L as shown in FIGS. 4–6 and pulled through to the point as shown in FIG. 7 where the band comfortably encircles the wrist or ankle without being so loose as to be capable of slipping off. Then, that portion of the plush strip 5 and the protective strip 23 extending out of the loop is cut off as shown in FIG. 8, as by means of a scissors indicated at S in FIG. 7. The protective strip 23 is then pulled out as shown in FIG. 9 to expose the plush face 19 of the plush strip and, by pressing on the loop L from the outside, the remaining portion of the plush strip 5 and the hook element 3 are pressed together to secure them together by entry of the hooks 7 (mushrooms) on the hook element in the plush 19 of the plush strip, thereby to secure the identification band in place around the wrist or ankle. The loop formation thereupon prevents separation of the plush strip end of the band from the hook element at the end of strip 1, and thus the band is effectively secured against intentional or accidental removal from the wrist or ankle. Alternatively, only the plush strip need be cut, and the cut-off end portion of the plush strip with the protective strip attached thereto removed.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An identification band, as for hospital patients, comprising a strip adapted to extend around a person's wrist or ankle and to carry identification data, hook and plush fastening elements for fastening the strip around the wrist or ankle, one of said elements forming one side of a loop means at one end of said strip and facing toward the inside of said loop means, the other element being a relatively long and narrow element at the other end of the strip, a protective strip on said other element extending lengthwise thereof secured to said other element adjacent the free end thereof, said other element and the protective strip being adapted to be passed through the loop means to the point where the band encircles the wrist or ankle to the desired extent with said other element facing toward said one element but separated therefrom by said protective strip, whereupon the portion of said other element extending out of the loop means and the protective strip may be removed and the elements pressed together to secure the band around the wrist or ankle, the loop means preventing separation of the elements.

2. An identification band as set forth in claim 1 wherein the data-carrying strip and the hook element are made of thermoplastic material, the hook element being heat-sealed to the strip.

3. An identification band as set forth in claim 2 wherein the hook element comprises a generally rectangular piece of thermoplastic material with hooks on one face thereof positioned on the data-carrying strip at said one end thereof extending transversely across the data-carrying strip from adjacent one edge thereof to adjacent the other with the hooks extending toward the data-carrying strip and heat-sealed at its side edges to the latter.

4. An identification band as set forth in claim 1 wherein the data-carrying strip, the plush element and the protective strip are made of thermoplastic material, the plush element and protective strip being narrower than the data-carrying strip and heat-sealed thereto at said other end thereof, the protective strip being heat-sealed to the plush strip at the free end of the latter.

5. An identification band as set forth in claim 1 wherein the data-carrying strip and hook element are made of thermoplastic material, the hook element being heat-sealed to the data-carrying strip, the plush element and the protective strip also being made of thermoplastic material, the plush element and protective strip being narrower than the data-carrying strip and heat-sealed thereto at said other end thereof, the protective strip being heat-sealed to the plush strip at the free end of the latter.

6. An identification band as set forth in claim 5 wherein the hook element comprises a generally rectangular piece of thermoplastic material with hooks on one face thereof positioned on the data-carrying strip at said one end thereof extending transversely across the data-carrying strip from adjacent one edge thereof to adjacent the other with the hooks extending toward the data-carrying strip and heat-sealed at its side edges to the latter.

7. An identification band as set forth in claim 1 wherein the data-carrying strip is transparent, said band further comprising a tape having pressure-sensitive adhesive on one face thereof constituting its inside face, and release means covering the pressure-sensitive adhesive except for an area at one end thereof, said tape being adhered to the data-carrying strip at said exposed area and extending lengthwise of the data-carrying strip on that face thereof which constitutes the inside as the band is applied to the wrist or ankle, said release means being removable to expose the pressure-sensitive adhesive on the tape for placement thereon of an insert having identification indicia on one face thereof between the tape and the data-carrying strip with said one face of the insert facing the latter.

8. An identification band as set forth in claim 1 wherein said one element is the hook element and the other is the plush element.

9. An identification band as set forth in claim 3 wherein said one element is the hook element and the other is the plush element.

10. An identification band as set forth in claim 6 wherein said one element is the hook element and the other is the plush element.

* * * * *